US005626528A

United States Patent [19]

Toulon

[11] Patent Number: 5,626,528

[45] Date of Patent: May 6, 1997

[54] GOLF CLUB HEAD AND HOSEL CONSTRUCTION

[75] Inventor: Sean G. Toulon, Vista, Calif.

[73] Assignee: Zevo Golf, Inc., Temecula, Calif.

[21] Appl. No.: 592,648

[22] Filed: Jan. 26, 1996

[51] Int. Cl.[6] ..... A63B 53/02

[52] U.S. Cl. ..... 473/248; 473/305; 473/314

[58] Field of Search ..... 473/305, 306, 473/307, 308, 309, 310, 311, 312, 313, 314, 315, 345, 246, 248

[56] References Cited

U.S. PATENT DOCUMENTS

| | | | |
|---|---|---|---|
| 796,802 | 8/1905 | Brown . | |
| 1,983,158 | 12/1934 | Young . | |
| 2,363,991 | 11/1944 | Reach . | |
| 3,191,936 | 6/1965 | Guier . | |
| 3,825,991 | 7/1974 | Cornell | 473/305 |
| 4,123,055 | 10/1978 | Brill . | |
| 4,842,243 | 6/1989 | Butler . | |
| 5,275,408 | 1/1994 | Desbiolles . | |

FOREIGN PATENT DOCUMENTS

| | | | |
|---|---|---|---|
| 854911 | 7/1949 | Germany . | |
| 10867 | 5/1903 | United Kingdom | 273/80.1 |

*Primary Examiner*—Sebastiano Passaniti
*Attorney, Agent, or Firm*—George J. Netter

[57] ABSTRACT

A golf club metal-wood head (10) includes a unitary hosel (16) having a continuous curved bottom groove (26) extending completely about the hosel to form a reduced bending moment region enabling the making of reliable minor adjustments in both lie and face angle of the club to achieve custom fitting to individual players.

8 Claims, 1 Drawing Sheet

GOLF CLUB HEAD AND HOSEL CONSTRUCTION

BACKGROUND

1. Field of the Invention

The present invention relates generally to a golf club, and, more particularly, to a golf club head and hosel construction enabling angular relations of the golf club head to ground plane to be adjusted to individual player requirements.

2. Description of Related Art

Golf clubs in their major aspects include a head portion with face specially adapted for striking the game ball and an elongated shaft which terminates at the upper end in a gripping portion. The head portion extends away from the shaft at an angle primarily determined by the length of the shaft, the height and other physical characteristics of the individual player. For example, a relatively short player will typically have a greater angle between the shaft and a vertical line through the head portion in that the individual tends to swing the club in a flatter or more horizontal plane or closer to the ground plane as opposed to, say, a very tall individual. The construction by the manufacturer of an individual club to a given angular relationship or lie of the head portion is merely selected as an average or statistical value and, therefore, will be more appropriate for some than others. It has been found, however, that it may be desirable to individually change the "lie" angle of the club head in order to more precisely accommodate specific physical characteristics of the individual who is going to use the club and in that way produce optimal ability to consistently and accurately strike a ball.

In the past, an individual buying clubs has been faced with standard amounts of variation in lie angle in a purchased set of clubs and after choosing the size that felt best would then frequently have a local professional or other golf club repairer bend the hosel a certain amount to obtain a precise customized lie angle for the club. Extensive testing has shown that having the lower face of the club at a proper angle with respect to the club shaft for the individual using the club is critical to being able to strike a ball more consistently and accurately. With an improper angle of club head to shaft, the individual will strike the ball either to the right or to the left of the desired target direction whereas proper lie will produce an accurate and lengthy shot.

In addition to club head lie, the slope of the striking face measured in a forward backward direction along the line of movement of the ball (i.e., open and closed) is also important to obtain proper ball striking and maximizing the distance obtainable by use of the particular club and moving the ball in the desired direction.. Although this angle of the striking face for the golf club head is set by the manufacturer at a predetermined angle, it has been found that an individual player will, by the manner in which the club is swung, inadvertently either increase or decrease the actual contact angle from what could be expected from, say, an expert swing. Accordingly, any given player may find it desirable to increase or decrease the face angle of one or more golf clubs in the golf set to fine tune the clubs to the player's individual swing. Although the above indicated lie and face adjustments of clubs can apply to either the so-called "woods" or "irons", the invention as described herein will be presented in connection with a wood club and, more particularly, to a so-called metal wood club.

SUMMARY OF THE INVENTION

A golf club with which the present invention is most advantageously employed is a so-called metal-wood club in which the head portion and hosel are of one-piece and constructed of metal. The shaft is then secured within the hosel and otherwise the club is used in conventional manner.

In accordance with the practice of the present invention, a metal wood clubhead is provided with a hosel having an outer surface that is slightly tapering along its length and of circular cross-section. The hosel outer surface immediately adjacent the club head itself is of reduced diameter as the result of a slot or groove being formed that extends continuously about the hosel periphery. As a result of this construction, the hosel can, upon application of transverse force to the hosel, be deformed or bent slightly in any direction about the hosel longitudinal axis to produce an adjustable modification of either the club head face angle, or the club head loft, or both, as desired. The actual bend point is accordingly confined to a predetermined region of the hosel.

DESCRIPTION OF A PREFERRED EMBODIMENT

Figure 1:
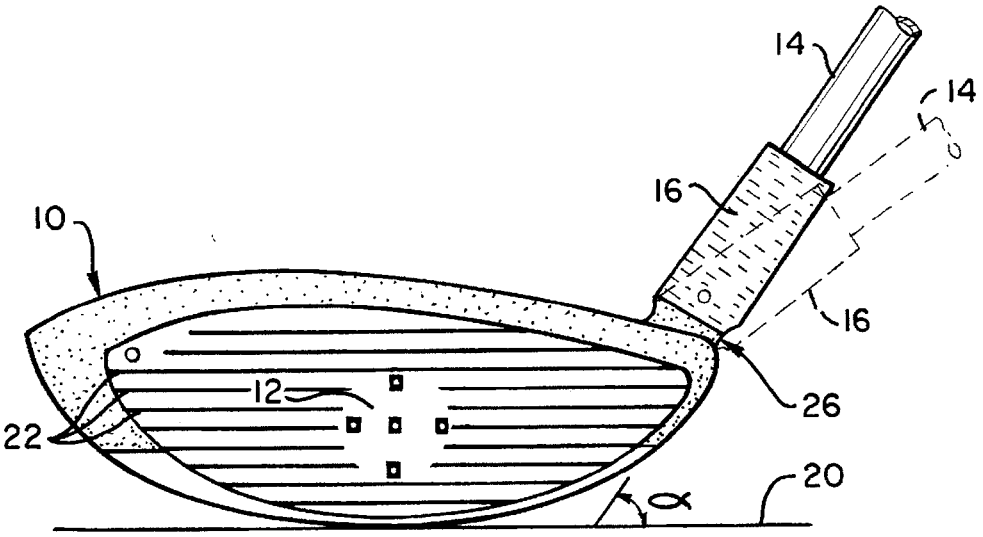
FIG. 1 is a side elevational view directly into the striking face of a golf club head, showing in diagrammatic manner the variation in lie of the club head.
Figure 2:
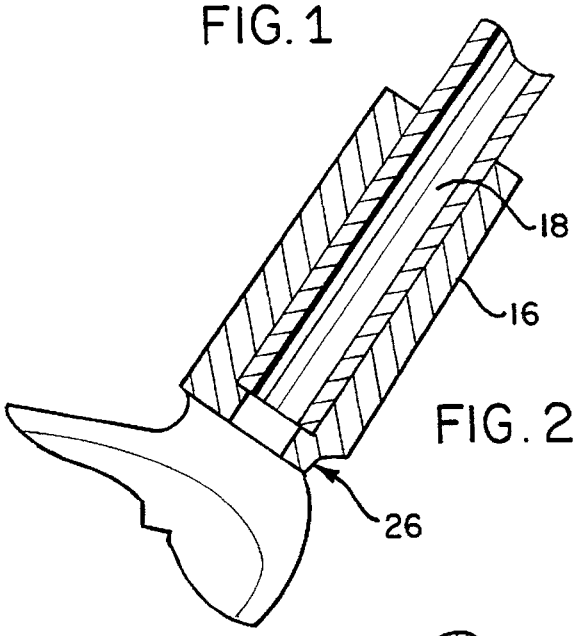
FIG. 2 is an enlarged, elevational, sectional, partially fragmentary view of the hosel and immediately adjacent part of the clubhead.

Turning now to the drawings and particularly FIG. 1 there is depicted in elevational view a head 10 of a golf club looking directly into the striking face 12 thereof. More particularly, the head 10 is that of a so-called metal-wood club which is constructed entirely of metal. A shaft 14 has one end which is angularly interconnected to the club head 10 via a so-called hosel 16 and at its outer end a conventional hand gripping portion (not shown) for swinging the club while playing the game of golf. The hosel is a generally tubular metal member having a slight longitudinal taper which is unitary with the metal shell defining the head 10 and made of the same metal. The bore 18 of the hosel is dimensioned to fittingly receive the shaft 14 therein and to which the shaft is tightly secured in any of a number of conventional ways.

In the solid line depiction, the club head 10 is shown resting on a ground plane 20 in preferred use orientation such that the various lines 22 typically existing on the club face 12 are generally parallel to the ground plane. At this time, and assuming that the player has otherwise properly taken a stance for correctly swinging the golf club, there is established a particular angle $\alpha$ of the shaft with respect to the ground plane and thus to the golf club head 10. This angular relationship of the head and shaft varies depending upon the length of the particular club and the physical characteristics of the player swinging the club. For example, a relatively short, stocky player will tend to have a smaller angle $\alpha$ as compared to that of a taller player. This, of course, means that in order to maintain the proper lie of the golf club head parallel to the ground surface during use, short and taller players must have clubs of differing lie angles. As has already been referenced, in manufacturing clubs and in order to reduce inventory problem, clubs are only made in a finite number of angular relationships between the shaft and head lower surface and in the past, if the desired lie was not correct in a purchased club, more likely than not the player merely put up with the inconsistency. Also in the past, where it was considered advisable to adjust the lie angle, depending upon the construction of the club, such adjustment could result in undesirable cracking of the hosel or loosening of the shaft.

To eliminate the adverse effects of prior techniques encountered in adjusting lie, the present invention forms a slot or groove 26 extending completely about the hosel in the juncture region of the hosel with the club head 10, itself. The slot wall surface is smooth and continuously curved.

With reference still to FIG. 1, on application of transverse bending force to the hosel while securing the head against lateral movement, the club hosel will bend in the slot region transversely of the shaft and hosel longitudinal axis. This corrective lie adjustment does not loosen the shaft securement within the hosel. Moreover, since the bending point is precisely determined for each club, predictability of adjustment results is insured. The dashed line depiction in FIG. 1 shows the club with one possible poor lie angle, and the solid line drawing shows the club with correct lie angle.

Figure 3:
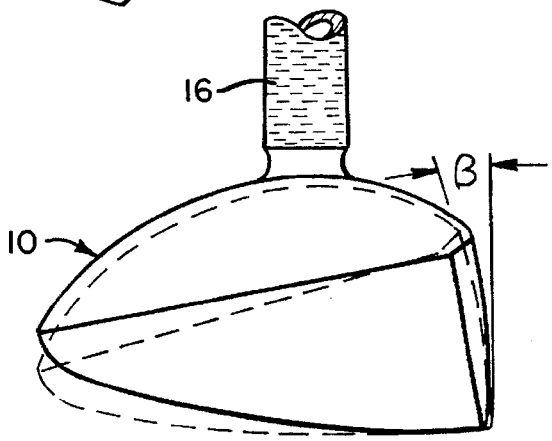
FIG. 3 is an end elevational view taken along the line 3—3 of FIG. 1.

As shown in FIG. 3, torsional bending adjustment of the club head in a direction about the hosel axis produces modification of the face angle β of the club striking face 12. The dashed line shows before loft correction and the solid line after correction. More particularly, while looking down along the club where the clubhead is torsionally rotated clockwise about the hosel axis, the club face is said to "open", and when adjusted counterclockwise the face is said to "close" (for a righthand player).

In a practical construction of the invention, the club head and hosel were constructed of stainless steel and the wall thickness in the slot is approximatly 0.060 inches. With this construction the club may be readily adjusted as much as 5 degrees in either direction for club face change and 7 degrees (up or down) for lie change without concern for damaging the club head or hosel integrity.

Although the invention has been described in connection with a preferred embodiment, it is to be understood that those skilled in the art may contemplate changes that come within the spirit of invention as disclosed and within the ambit of the appended claims.

What is claimed is:

1. A golf club construction, comprising:

a ball-striking metal head;

a hosel integrally unitary with the head having an opening extending from an outer surface into said hosel and including a continuous groove extending in an outer surface of said hosel about the opening at which groove bending can be effected in any direction to adjust club head lie and a shaft having an end portion received with said head opening.

2. A golf club construction as in claim 1, in which the groove is concavely outwardly directed, smoothly curved and located immediately adjacent the metal head.

3. A golf club construction as in claim 2, in which the hosel has an opening for receiving an end portion of a club shaft therein, an internal end of said hosel opening including a shoulder locating an inner shaft end at a position other than coextensive with the groove.

4. A golf club construction as in claim 1, in which the hosel has a portion that tapers from a minimum cross-section at an outer end to a maximum cross-section immediately adjacent the groove.

5. A golf club construction as in claim 1, in which the hosel extends outwardly away from the metal head and the transverse bending moment of said hosel is least measured through the groove.

6. A golf club head and hosel construction for being received on an end portion of a shaft, comprising:

a metal shell head including a ball striking face and hosel formed in one piece;

said hosel being generally cylindrical elongated and tapered having one end unitarily related to said head, and having a uniformly increasing transverse bending moment moving from a hosel outer end toward the head except along an exterior portion immediately adjacent the head of reduced bending moment characteristic such that transverse bending forces applied outwardly of the reduced bending moment portion produces bending at the reduced bending moment portion.

7. A golf club head and hosel construction as in claim 6, in which the reduced bending moment hosel portion includes a ring-like groove in the hosel periphery extending about the hosel in a closed path.

8. A golf club head and hosel construction as in claim 7, in which the hosel has an opening for receiving an end portion of a club shaft therein, an internal end of said hosel opening including a shoulder maintaining all parts of the shaft beyond the portion of reduced bending movement characteristic.

* * * * *